US010386785B2

(12) United States Patent
Sasaki et al.

(10) Patent No.: US 10,386,785 B2
(45) Date of Patent: Aug. 20, 2019

(54) CLEANING APPARATUS, PROCESS CARTRIDGE AND IMAGE FORMING APPARATUS

(71) Applicant: CANON KABUSHIKI KAISHA, Tokyo (JP)

(72) Inventors: Teruhiko Sasaki, Mishima (JP); Toshiaki Takeuchi, Susono (JP); Takahito Ueno, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/593,436

(22) Filed: May 12, 2017

(65) Prior Publication Data

US 2017/0248897 A1 Aug. 31, 2017

Related U.S. Application Data

(62) Division of application No. 15/049,735, filed on Feb. 22, 2016, now Pat. No. 9,684,276.

(30) Foreign Application Priority Data

Feb. 27, 2015 (JP) ..... 2015-038036

(51) Int. Cl.
*G03G 21/16* (2006.01)
*G03G 21/10* (2006.01)
(Continued)

(52) U.S. Cl.
CPC ..... *G03G 21/169* (2013.01); *G03G 21/0011* (2013.01); *G03G 21/10* (2013.01); *G03G 21/1647* (2013.01); *G03G 21/1814* (2013.01)

(58) Field of Classification Search
USPC ..... 399/9, 12, 13, 107, 110–113, 116, 117, 399/119
See application file for complete search history.

(56) References Cited

U.S. PATENT DOCUMENTS 5,678,121 A 10/1997 Meetze, Jr. et al.
5,828,935 A * 10/1998 Tatsumi ..... G03G 15/0868 399/260

(Continued)

FOREIGN PATENT DOCUMENTS

JP 2011-150070 A 8/2011
JP 2014-066794 A 4/2014

OTHER PUBLICATIONS

U.S. Appl. No. 15/054,308, filed Feb. 26, 2016.
Office Action dated Nov. 13, 2018, in Japanese Patent Application No. 2015-038036.

*Primary Examiner* — Hoan H Tran
(74) *Attorney, Agent, or Firm* — Venable LLP

(57) ABSTRACT

This invention concerns a cleaning unit which has a photosensitive body and a cleaning frame body supporting the photosensitive body, and which is attachable to and detachable from an apparatus main body of an image forming apparatus configured to form an image on a recording material. In the cleaning unit, which is installed in the apparatus main body so as to adjoin a developing unit including a developing roller that bears toner for developing an electrostatic image formed on the photosensitive body 1, engagement portions (bosses) are disposed on the cleaning frame body so as to protrude toward the developing unit side, and engage with engaged portions (insertion guide portions) disposed on the apparatus main body when the cleaning unit is attached to the apparatus main body.

20 Claims, 16 Drawing Sheets

(51) Int. Cl.
*G03G 21/00* (2006.01)
*G03G 21/18* (2006.01)

(56) References Cited

U.S. PATENT DOCUMENTS

| | | | | |
|---|---|---|---|---|
| 6,327,448 | B1 * | 12/2001 | Sasaki | G03G 21/181 399/111 |
| 6,501,926 | B1 * | 12/2002 | Watanabe | F16D 1/101 399/117 |
| 6,714,749 | B2 * | 3/2004 | Sato | G03G 21/1832 399/102 |
| 7,512,363 | B2 * | 3/2009 | Kamimura | G03G 21/1871 399/113 |
| 7,702,253 | B2 * | 4/2010 | Nishimura | G03G 21/1825 399/111 |
| 2011/0013933 | A1 * | 1/2011 | Sato | G03G 15/0935 399/111 |
| 2014/0086627 | A1 | 3/2014 | Tanabe et al. | |

* cited by examiner

CLEANING APPARATUS, PROCESS CARTRIDGE AND IMAGE FORMING APPARATUS

This is a divisional of U.S. patent application Ser. No. 15/049,735, filed Feb. 22, 2016.

BACKGROUND OF THE INVENTION

Field of the Invention

The present invention relates to a cleaning apparatus, a process cartridge and an image forming apparatus.

Description of the Related Art

In a conventional image forming apparatus using an electro-photographic image forming process, a process cartridge system is used, where an electro-photographic photosensitive body and a process means, which acts on the electro-photographic receptor, are integrated into a cartridge, and detachably attaches to an apparatus main body of the image forming apparatus.

According to the process cartridge system, the user can perform maintenance on the image forming apparatus themselves without depending on service personnel, hence convenience can be dramatically improved. Therefore this process cartridge system is widely used for electro-photographic image forming apparatuses.

However, in the cartridge type electro-photographic image forming apparatus, it may occur that not only a cartridge of which functions are compatible with the image forming apparatus (hereafter called "compatible cartridge"), but also a cartridge of which functions are not compatible therewith (hereafter called "incompatible cartridge") may be installed.

To solve the above compatibility problem, an image forming apparatus that has a configuration to prevent the insertion of an incompatible cartridge was proposed (Japanese Patent Application Laid-open No. 2014-66794). In this image forming apparatus, a first boss and a second boss are disposed on the outer side face of the cartridge extending in the inserting direction, and a movable stand, constituted by a first insertion guide portion which engages with the first boss and a second insertion guide portion which engages with the second boss, is disposed on the image forming apparatus main body. If an incompatible cartridge is inserted, the second boss and the second insertion guide portion cannot engage even through the movable stand is moved by the first boss, whereby insertion error is prevented.

SUMMARY OF THE INVENTION

Means to Solve the Problem

In the conventional configuration, the error insertion prevention configuration is disposed on the outer side face of the cartridge (cleaning apparatus having a photosensitive body) extending in the inserting direction. If the image forming apparatus is configured such that a plurality of cartridges are installed in the image forming apparatus, a space for disposing the error insertion prevention configuration must be secured between adjacent cartridges. However, downsizing is demanded for an image forming apparatus, so that space to install the apparatus is saved, and the price of the image forming apparatus is reduced.

With the foregoing in view, it is an object of the present invention to prevent the insertion of an incompatible cleaning apparatus upon installing a cleaning apparatus in the image forming apparatus main body, and to make downsizing of the image forming apparatus possible.

To achieve the above object, the present invention concerns a cleaning apparatus including a photosensitive body, and a frame body that supports the photosensitive body, and being attachable to and detachable from an apparatus main body of an image forming apparatus configured to form an image on a recording material. The cleaning apparatus is installed in the apparatus main body, so as to adjoin a developing cartridge including a developer bearing member that bears developer for developing an electrostatic image formed on the photosensitive body, and an engagement portion is provided on the frame body so as to protrude toward a side where the developing cartridge is installed and engage with an engaged portion, which is disposed on the apparatus main body, when the cleaning apparatus is attached to the apparatus main body.

The present invention also concerns a process cartridge that is attachable to and detachable from an apparatus main body of an image forming apparatus, including the cleaning apparatus, and a developing cartridge including a developer bearing member that bears developer for developing an electrostatic image formed on the photosensitive body.

The present invention also concerns an image forming apparatus configured to form an image on a recording material, and either a plurality of cleaning apparatuses or a plurality of process cartridges are configured to be attachable to and detachable from the apparatus main body.

Further features of the present invention will become apparent from the following description of exemplary embodiments (with reference to the attached drawings).

DESCRIPTION OF THE EMBODIMENTS

Embodiments of the present invention will now be described in detail with reference to the drawings. The dimensions, materials, shapes, relative positions or the like of the components described in the embodiments should be appropriately changed depending on the configuration and various conditions of an apparatus to which the invention is applied, and are not intended to limit the scope of the invention to the following embodiments.

In this invention, a process cartridge is a cartridge that integrates an electro-photographic photosensitive body (hereafter called "photosensitive body") and at least a developing means as a process means that acts on the photosensitive body, and is attachable to and detachable from an electro-photographic image forming apparatus main body. Here the electro-photographic image forming apparatus (hereafter called "image forming apparatus") is configured to form an image on a recording material (recording medium) using the electro-photographic image forming process. Examples of the image forming apparatus are: a printer (e.g. laser beam printer, LED printer), a copier, a facsimile device, a word processor and a composite machine thereof (multi-function printer). In the present invention, the image forming apparatus is configured such that a plurality of cleaning apparatuses having a photosensitive body or a plurality of process cartridges are detachably attached to the image forming apparatus main body.

EXAMPLE

An example of the present invention will now be described.

General Configuration Outline of Image Forming Apparatus

General Configuration of Image Forming Apparatus

Figure 2:
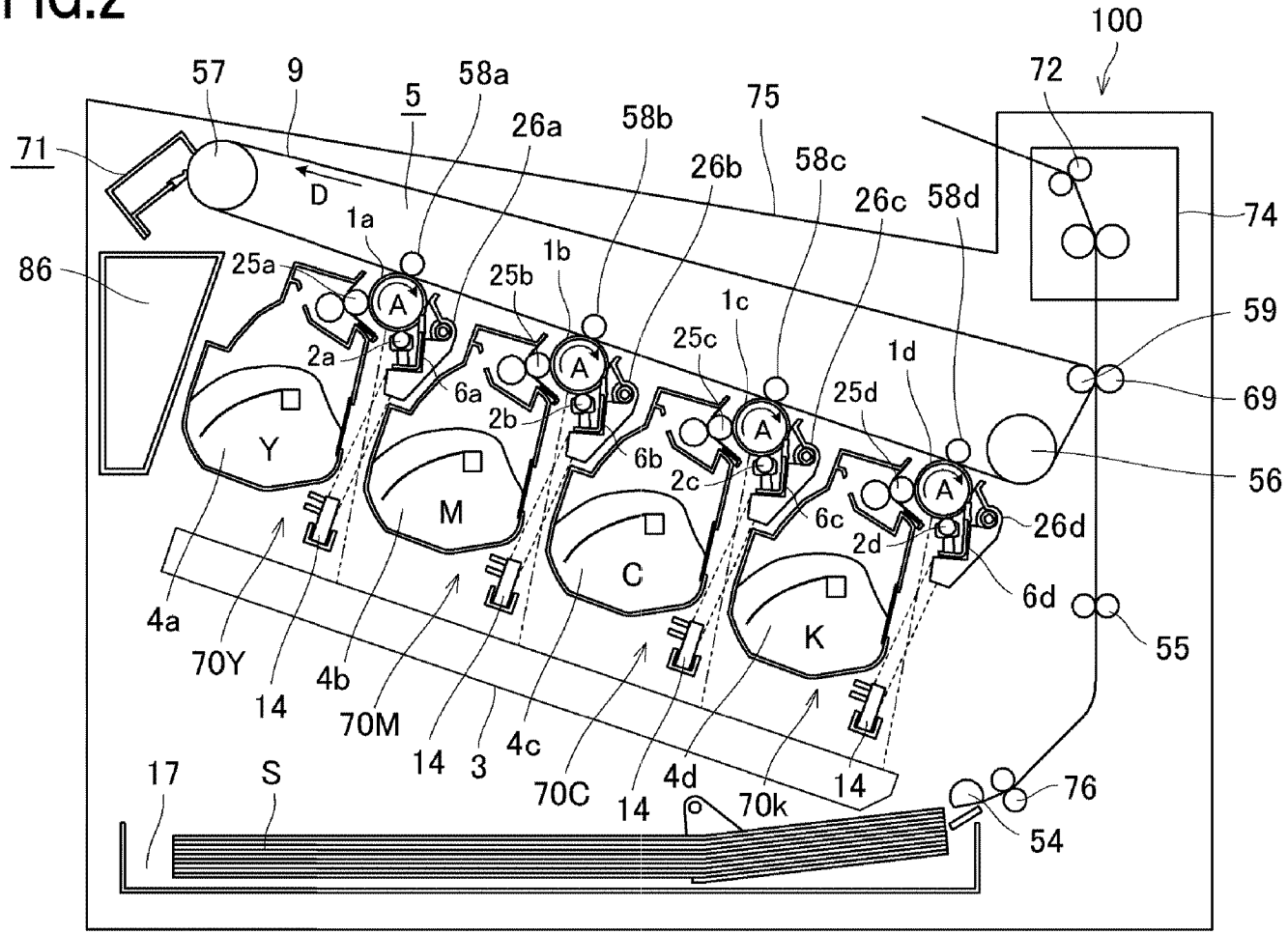
FIG. 2 is a schematic cross-sectional view depicting a general configuration of an image forming apparatus according to the example.

FIG. 2 is a schematic cross-sectional view depicting a general configuration of an image forming apparatus of this example. As shown in FIG. 2, four detachable process cartridges 70 (70Y, 70M, 70C and 70K) are installed in an apparatus main body 100 of the image forming apparatus by installing members (not illustrated). The process cartridges 70Y, 70M, 70C and 70K are used to form an image with each color: yellow (Y), magenta (M), cyan (C) and black (K) respectively. In this example, it is defined that the front side is the upstream side in the installing direction when the process cartridge 70 is installed in the apparatus main body 100, and the rear side is the downstream side in this installing direction. Further, in this example, the vertical direction and the horizontal direction are defined in the state when the image forming apparatus is installed (state in FIG. 2).

In FIG. 2, in the apparatus main body 100, each process cartridge 70 is installed side by side in an inclined state with respect to the horizontal direction.

In each process cartridge 70, a photosensitive body (1*a*, 1*b*, 1*c*, 1*d*) and a process means that acts on each photosensitive body 1 are integrated into a cartridge. In concrete terms, the process cartridge 70 is configured to include a developing unit 4 (4*a*, 4*b*, 4*c*, 4*d*) and a cleaning unit 26 (26*a*, 26*b*, 26*c*, 26*d*). As the process means, a charging roller 2 (2*a*, 2*b*, 2*c*, 2*d*) which is the charging member, a developing roller 25 (25*a*, 25*b*, 25*c*, 25*d*) which is the developer bearing member, a cleaning member 6 (6*a*, 6*b*, 6*c*, 6*d*) and the like are disposed around the photosensitive body 1.

The charging roller 2 is for uniformly charging the surface of the photosensitive body 1, and the developing roller 25 is for bearing toner and developing the latent image (electrostatic image) formed on the photosensitive body 1 by the bearing toner so as to make the latent image visible. The cleaning member 6 removes toner that remains on the photosensitive body 1 after the toner image formed on the photosensitive body 1 is transferred to a recording medium.

A scanner unit 3 that selectively exposes the photosensitive body 1 based on the image information and forms a latent image on the photosensitive body 1 is disposed below the process cartridges 70.

A cassette 17 containing recording material S is installed in the lower part of the apparatus main body 100. A recording material transport means is disposed so that the recording material S bypasses a secondary transfer roller 69 and a fixing unit 74, and is transported to the upper part of the apparatus main body 100. As the recording material transfer means, a feed roller 54 that separates and feeds the recording material S in the cassette 17 one sheet at a time, a transport roller pair 76 that transports the fed recording material S, and a resist roller pair 55 for synchronizing the latent image formed on the photosensitive body 1 and the recording material S, are disposed in this example.

An intermediate transfer unit 5 which is an intermediate transfer means, on which a toner image formed on each photosensitive body 1 (1*a*, 1*b*, 1*c*, 1*d*) is transferred (primary transfer), is disposed above the process cartridge 70 (70Y, 70M, 70C and 70K).

The intermediate transfer unit 5 includes: a driver roller 56, a driven roller 57, primary transfer rollers 58 (58*a*, 58*b*, 58*c*, 58*d*), a counter roller 59 and a transfer belt 9 which is wound around these rollers. The transfer belt 9 is installed so as to circulate while facing and contacting all the photosensitive bodies 1. Each primary transfer roller 58 (58*a*, 58*b*, 58*c*, 58*d*) is disposed on a position facing the photosensitive body 1 of each color respectively. The counter roller 59 is disposed on a position facing the secondary transfer roller 69. When voltage is applied to the primary transfer rollers 58 (58*a*, 58*b*, 58*c*, 58*d*), primary transfer is performed, where the toner image formed on each photosensitive body 1 is transferred to the transfer belt 9.

When voltage is applied to the counter roller 59 and the secondary transfer roller 69, which are disposed on the inner side of transfer belt 9, the toner on the transfer belt 9 is transferred to the recording material S (secondary transfer).

To form an image, each photosensitive body 1 is rotated and uniformly charged by the charging roller 2, then a latent image according to the image information is formed on each photosensitive body 1 by a laser light 3*a* (FIG. 3) emitted from the scanner unit 3 according to the image information. The latent image formed on each photosensitive body 1 is developed by the developing roller 25, whereby a toner image having a respective color is formed on each photosensitive body 1.

Synchronizing with the image formation, the recording material S is transported by the resist roller pair 55 to a secondary transfer position, where the counter roller 59 and the secondary transfer roller 69 contact each other via the transfer belt 9. Then when the transfer bias voltage is applied to the secondary transfer roller 69, each color of the toner image on the transfer belt 9 is transferred to the recording material S (secondary transfer).

Thereby the color image is formed on the recording material S. The recording material S on which the color image is formed is heated and pressed by the fixing unit 74, whereby the toner image is fixed. Then the recording material S is ejected into an ejecting unit 75 by an ejection roller 72. The fixing unit 74 is disposed on the upper part of the apparatus main body 100.

Primary untransferred toner, which remains on each photosensitive body 1 after the primary transfer step, is removed by the cleaning member 6. Secondary untransferred toner, which remains on the transfer belt 9 after the secondary transfer step, is removed by a transfer belt cleaning apparatus 71. The untransferred toner (removed toner) that is removed is discharged to a removed toner box 86 of the image forming apparatus 100. The method of transporting the removed toner will be described later.

Process Cartridge

Figure 3:
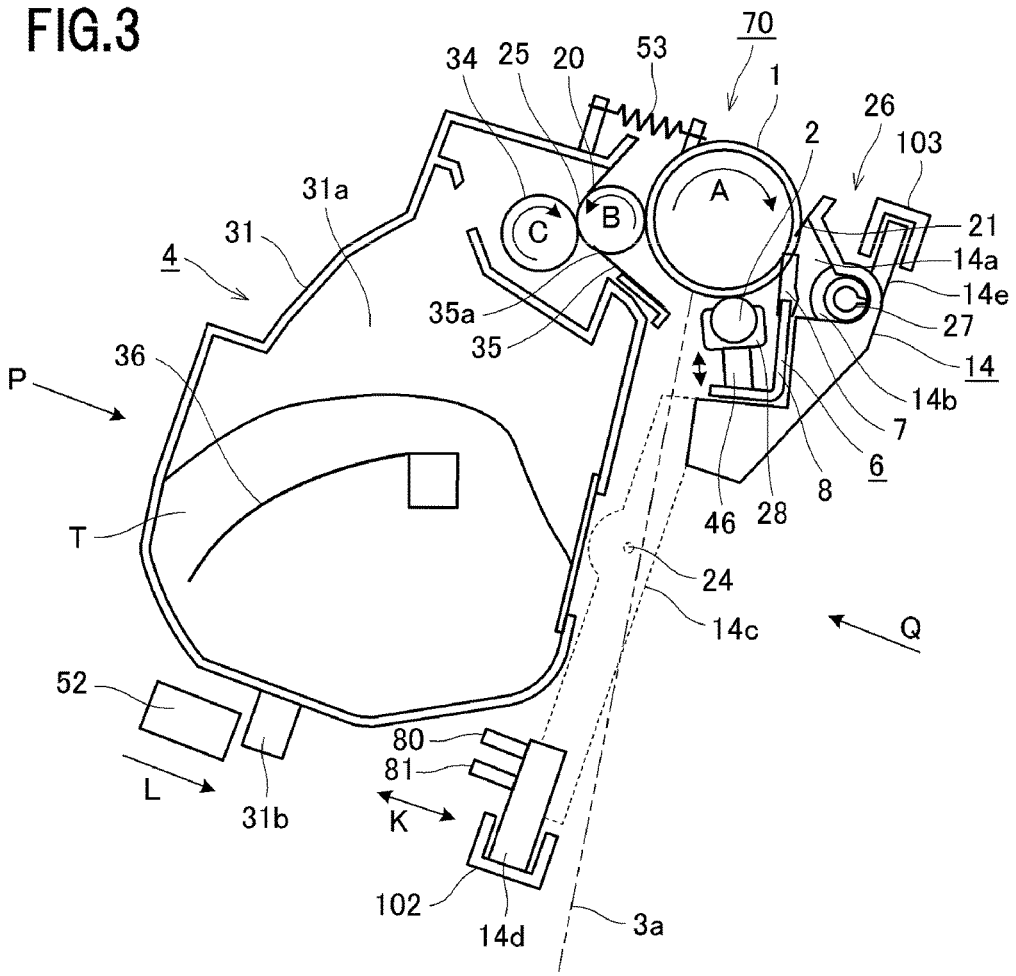
FIG. 3 is a schematic cross-sectional view of a process cartridge storing toner according to the example.

Now the process cartridge 70 of this example will be described with reference to FIG. 3 to FIG. 5. FIG. 3 is a schematic cross-sectional view of the process cartridge 70 containing toner. The configuration and operation of each process cartridge are substantially the same, except for the color of the toner. Therefore in the following description, the suffixes a, b, c and d, which are attached to each composing element of the process cartridge in FIG. 2 to indicate a color for which each element is disposed, are omitted unless distinction is required. The process cartridge 70 includes the cleaning unit 26 which is the cleaning apparatus, and the developing unit 4 which is a developing cartridge (developing means). As shown in FIG. 3, the cleaning unit 26 and the developing unit 4 are disposed adjacent to each other. The cleaning unit 26 includes: the photosensitive body 1, the charging roller 2, the cleaning member 6 and a cleaning frame body 14 to support these members. The developing unit 4 includes the developing roller 25 and a developing frame body 31 to support the developing roller 25.

The charging roller 2 and the cleaning member 6 are disposed on the peripheral surface of the photosensitive body 1, as mentioned above. The cleaning member 6 is constituted by an elastic member 7 made of a rubber blade, and a cleaning support member 8.

The elastic member 7 is disposed so that the tip thereof contacts the surface of the photosensitive body 1 in the direction facing the rotating direction of the photosensitive body 1. The removed object, such as residual toner removed from the surface of the photosensitive body 1 by the cleaning member 6, drops into a removed toner chamber 14*a*, which is a housing portion, and is stored there. Further, a squeegee sheet 21, to prevent the leakage of the removed toner from the removed toner chamber 14*a*, contacts the photosensitive body 1. When the drive force of a main body drive motor (not shown in figures), which is a drive source, is transferred to the cleaning unit 26, the photosensitive body 1 is rotary-driven according to the image forming operation. The charging roller 2 is rotatably installed in the cleaning unit 26 via a charging roller bearing 28, and is pressed toward the photosensitive body 1 by a charging roller pressing member 46, and is rotated together with the photosensitive body 1.

On the peripheral surface of the developing roller 25 of the developing unit 4, a toner supply roller 34 which contacts the developing roller 25 and rotates in the arrow C direction in FIG. 3, and a developing blade 35 for controlling the layer thickness of the toner born on the developing roller 25, are disposed respectively. Further, a blow out prevention sheet 20, for preventing the leakage of toner from the developing frame body 31 which is contacting the developing roller 25, is disposed. Furthermore, a toner transport member 36, for stirring the contained toner and transporting the toner to the toner supply roller 34, is disposed on a toner storage chamber 31*a* of the developing frame body 31.

The developing unit 4 is rotatably connected to the cleaning unit 26, centering around a fitting shaft 24 which is fixed to the cleaning frame body 14 of the cleaning unit 26. The developing unit 4 is energized by a tension spring 53. Therefore in the process cartridge 70 upon image formation, the developing unit 4 rotates around the fitting shaft 24, and the photosensitive body 1 and the developing roller 25 are in a contact state.

A pressing portion 31*b* is disposed on the developing frame body 31 of the developing unit 4, and a separation lever 52 is disposed on the apparatus main body 100. When an image is not formed, the separation lever 52 moves in the L direction in FIG. 3 while pressing the pressing portion 31*b*, whereby the developing unit 4 rotates around the fitting shaft 24, and the photosensitive body 1 and the developing roller 25 are separated.

Now a way of transporting the removed toner will be described. FIG. 4 is a schematic cross-sectional view depicting a transport path of the removed toner in the process cartridge. FIG. 5 is a schematic cross-sectional view depicting a transport path of the removed toner in the apparatus main body 100.

In the above mentioned removed toner chamber 14*a*, a transport path 14*b* for transporting the removed toner stored inside is disposed, and a transport screw 27 is disposed onside the transport path 14*b*. The transport screw 27 is disposed such that the rotation axis direction is parallel with the rotation axis direction of the photosensitive body 1.

Figure 4:
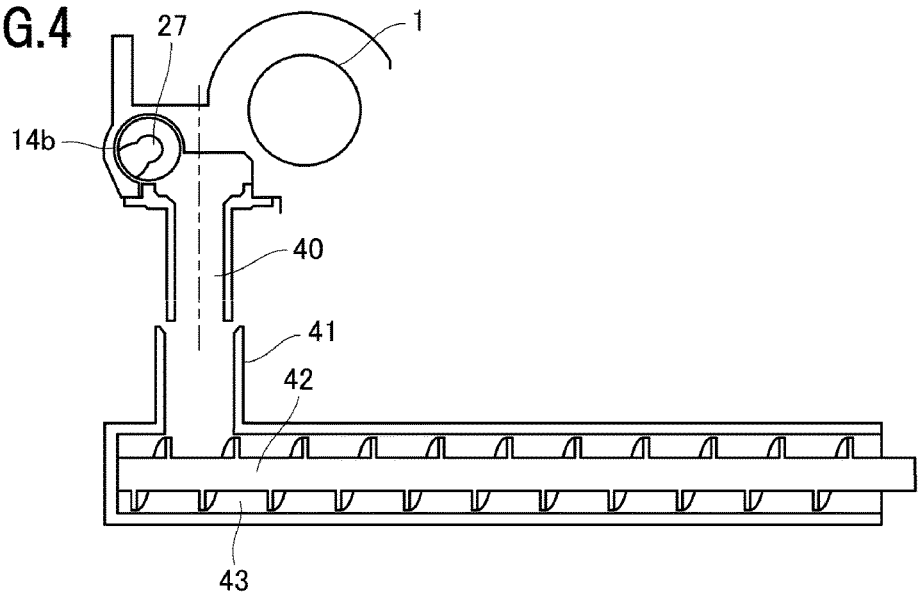
FIG. 4 is a diagram depicting a transport path of removed toner in the process cartridge.
Figure 5:
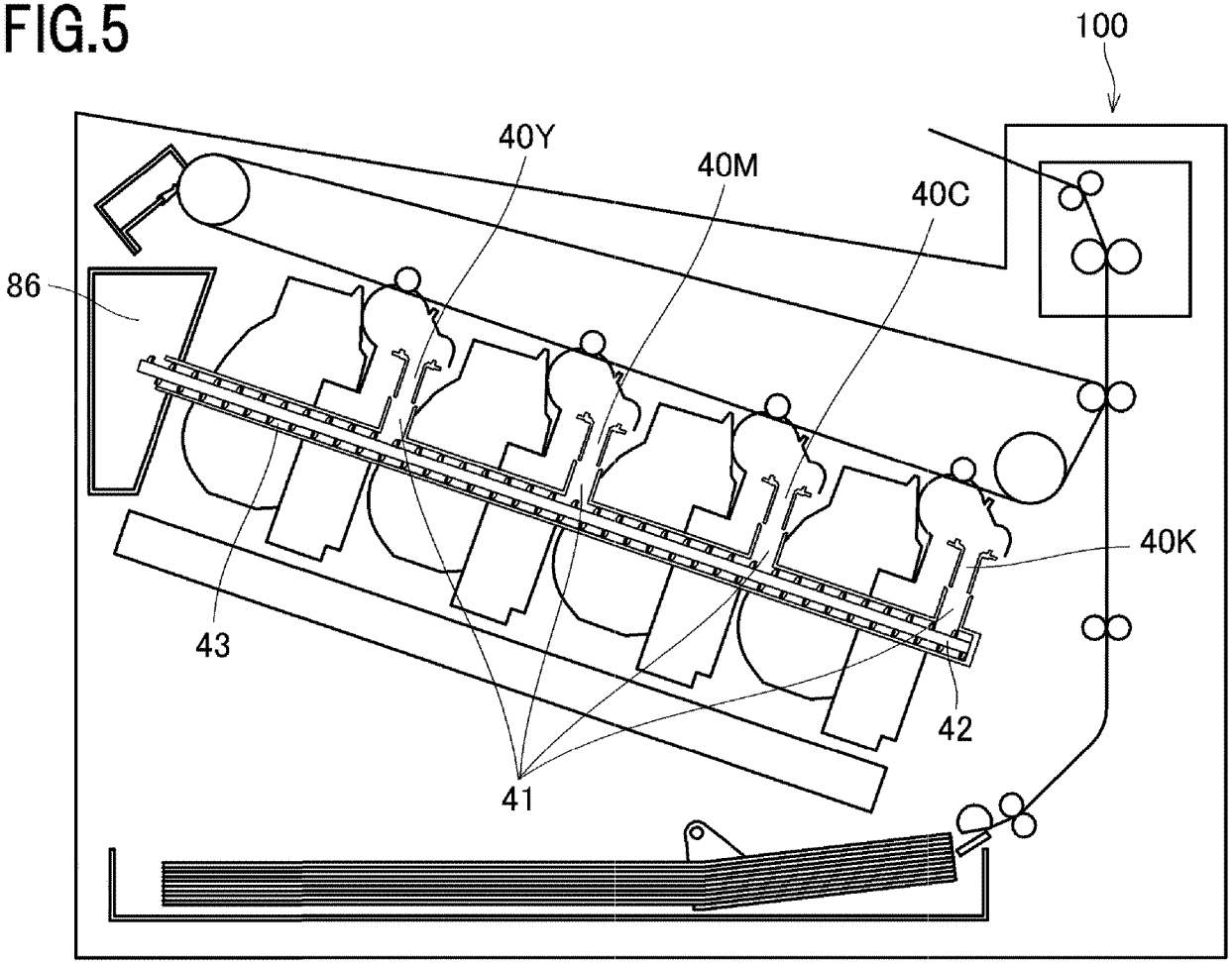
FIG. 5 is a diagram depicting a transport path of removed toner in the apparatus main body.

As shown in FIG. 4, on the edge of the downstream side of the removed toner transport direction of the transport path 14*b*, a second transport path 40 (40Y, 40M, 40C, 40K) for the removed toner to pass through is disposed, extending in a direction orthogonal to the transport direction of the transport path 14*b*, and in the gravity direction.

The removed toner is transported in the rotation axis direction from the removed toner chamber 14*a* by the transport screw 27, and is discharged from the second transport path 40 to an inlet 41 of a main body main transport path 43. Then as shown in FIG. 5, the removed toner is transported to a removed toner box 86 by a main body transport screw 42 disposed on the main body main transport path 43, and is stored.

Configuration to Insert Process Cartridge into Apparatus Main Body

A configuration to insert the process cartridge 70 into the apparatus main body 100 will now be described.

Figure 6:
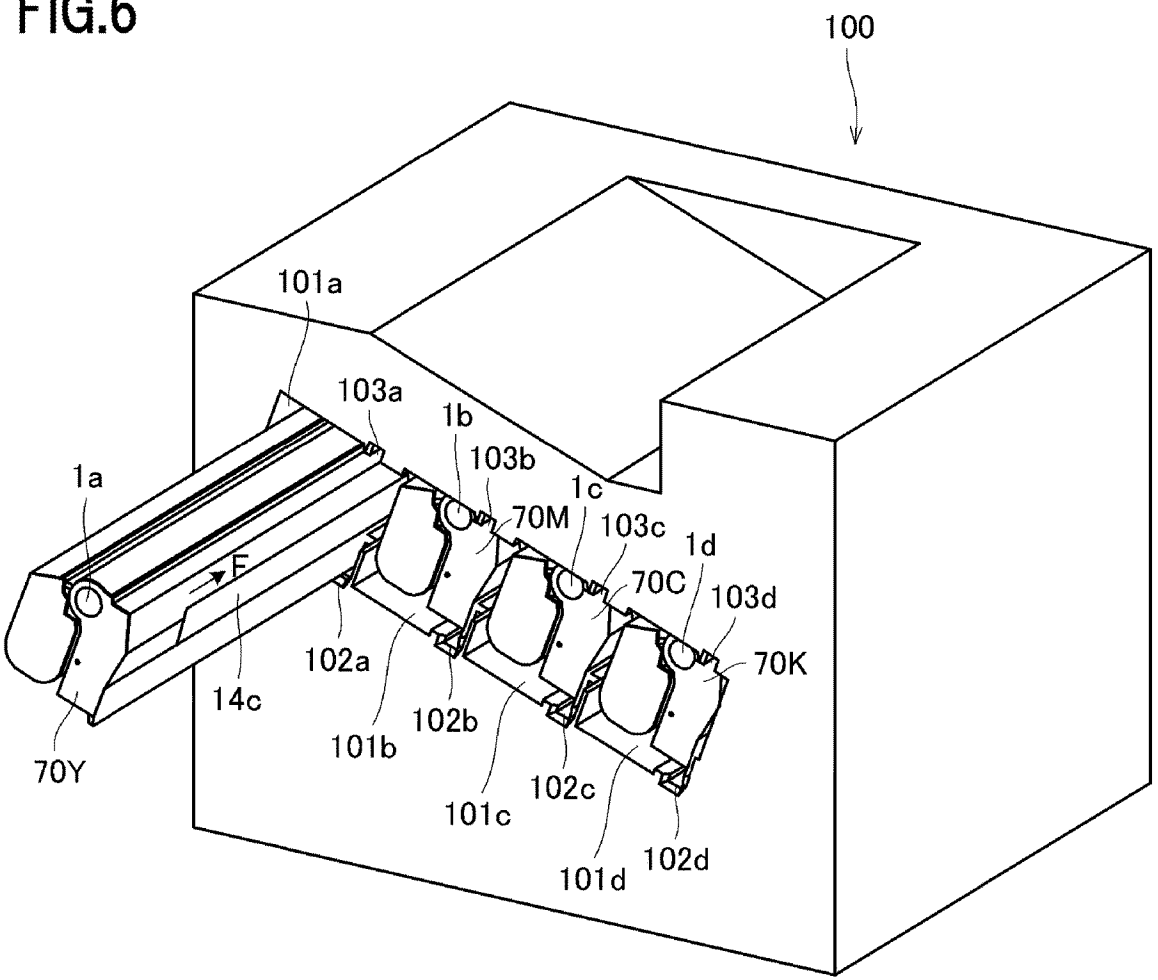
FIG. 6 is a diagram depicting a configuration to insert the process cartridge into the apparatus main body.

FIG. 6 is a diagram depicting the configuration to insert the process cartridge 70 into the apparatus main body 100.

In the apparatus main body 100, an apparatus opening 101 (101*a*, 101*b*, 101*c*, 101*d*), which is an opening to attach/detach the process cartridge 70 (70Y, 70M, 70C, 70K), is disposed. The direction to insert each process cartridge 70 into each apparatus opening 101 is parallel with the rotation axis direction of each photosensitive body 1, and is a direction from the front side to the rear side (arrow F direction) in FIG. 6. Hereafter the direction to insert the process cartridge 70 into the apparatus opening 101 (inserting direction, installing direction) is called "inserting direction F".

In the apparatus main body 100, an upper installation guide portion 103 (103*a*, 103*b*, 103*c*, 103*d*) is disposed on the upper side of each apparatus opening 101, and a lower installation guide portion 102 (102*a*, 102*b*, 102*c*, 102*d*) is disposed on the lower side thereof. Each of the upper installation guide portion 103 and the lower installation guide portion 102 has a guide shape extending in the inserting direction F of the process cartridge 70. As shown in FIG. 3, a first guided portion 14*d* of the cleaning frame body 14 is guided to the lower installation guide portion 102, and a second guided portion 14*e* of the cleaning frame body 14 is guided to the upper installation guide portion 103.

The user positions the process cartridge 70 on the front side in the inserting direction F of the lower installation guide portion 102, and moves the process cartridge 70 in the inserting direction F along the upper installation guide portion 103 and the lower installation guide portion 102, so as to insert the process cartridge 70 into the apparatus main body 100.

Characteristic Configuration of this Example

A characteristic of this example is the configuration which allows only a process cartridge 70 that is compatible with a specific apparatus main body 100 to be installed in the apparatus main body 100, and prevents the insertion of a process cartridge that is incompatible with the apparatus main body 100 into the apparatus main body 100 by mistake.

This characteristic configuration will now be described with reference to FIG. 1, FIG. 3 and FIG. 7 to FIG. 16B, assuming that a process cartridge 70*a* is compatible with a specific apparatus main body 100*a*, and a process cartridge 70A is compatible with another specific apparatus main body 100A.

First a basic configuration will be described using the apparatus main body 100*a* and the process cartridge 70*a* which is compatible with the apparatus main body 100*a*.

Figure 1:
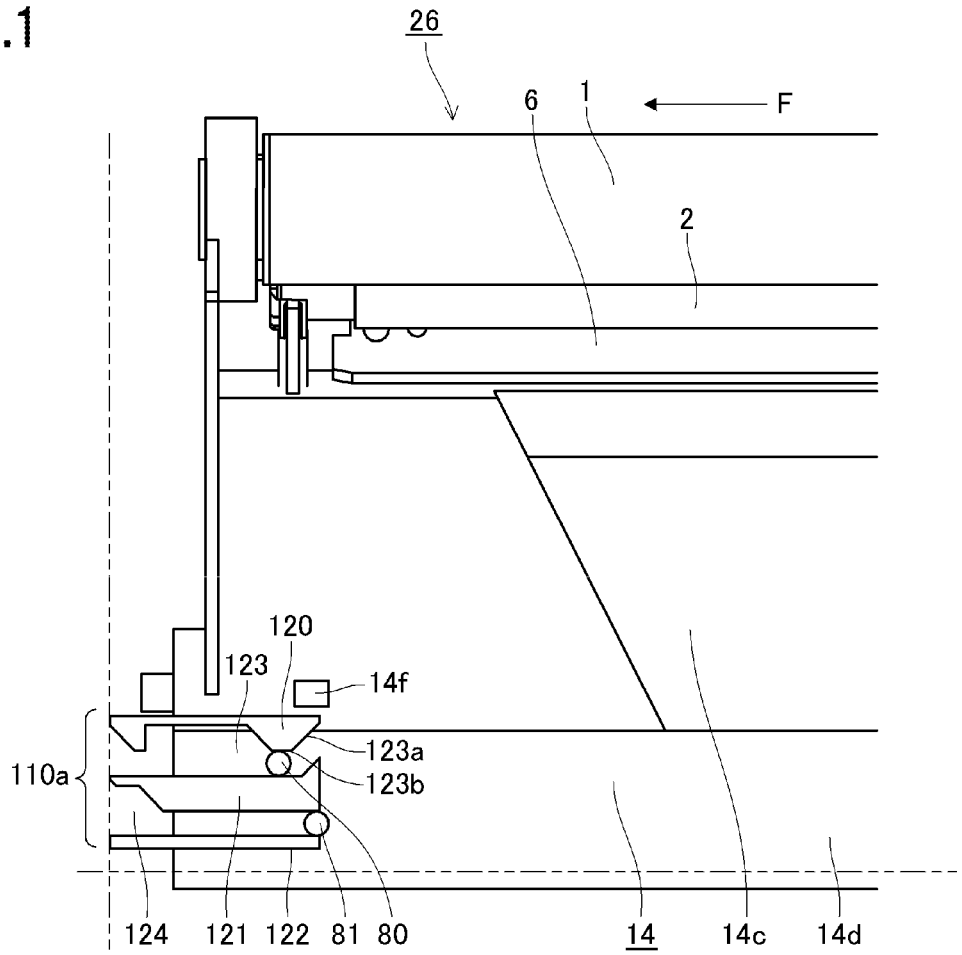
FIG. 1 is a schematic diagram depicting a key portion of a process cartridge according to an example.

FIG. 1 is a schematic diagram depicting a key portion of the process cartridge 70, for describing the relationship of the process cartridge 70 and the movable stand 110*a* of the apparatus main body 100.

Figure 7:
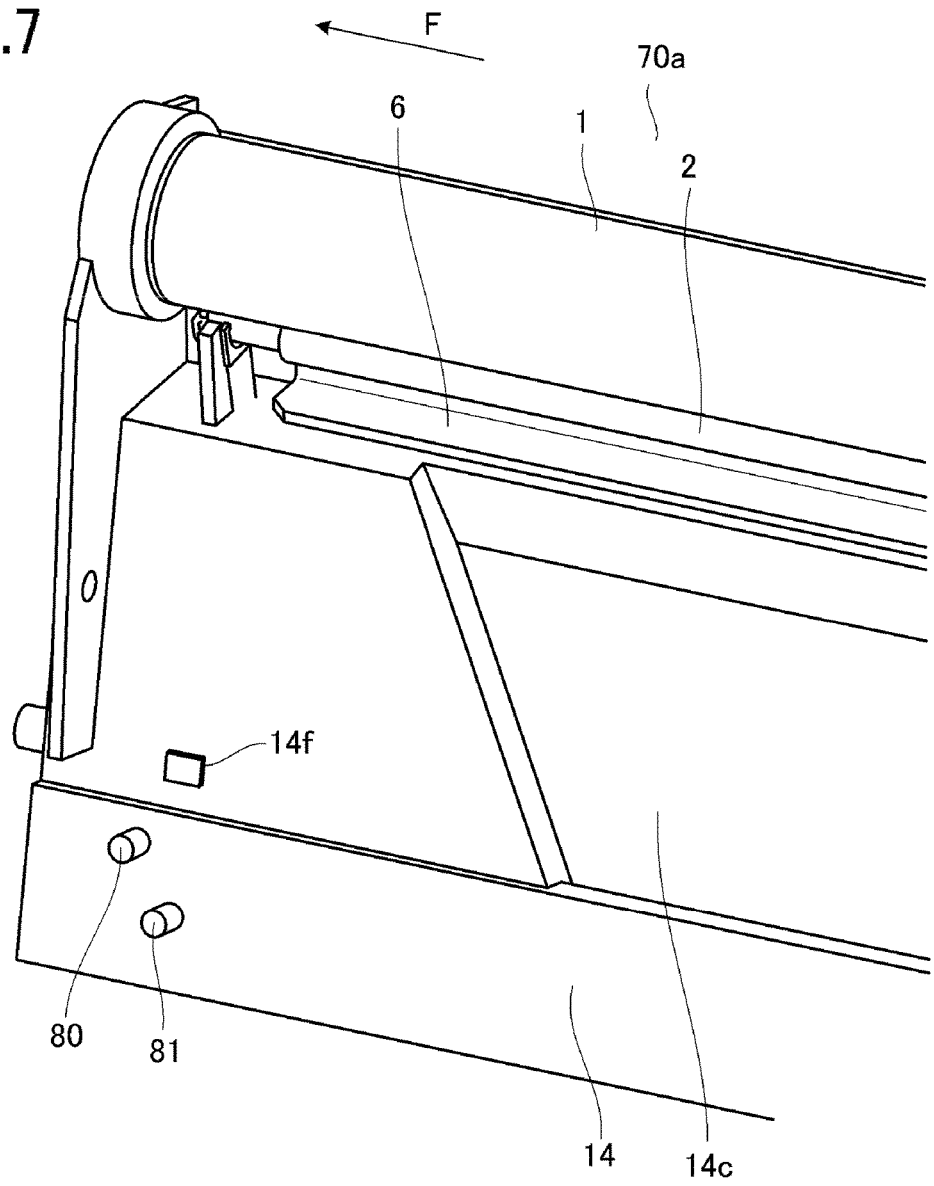
FIG. 7 is a schematic diagram depicting the key portion of the process cartridge.

FIG. 7 is a schematic diagram depicting a key portion of the process cartridge 70*a*, viewing the process cartridge 70 in the arrow P direction in FIG. 3. In FIG. 7, the developing unit 4 is not illustrated to make explanation easier. In FIG. 1, FIGS. 9A to 9F, FIGS. 10A to 10F, FIGS. 13A to 13C and FIGS. 14A and 14B, the virtual reference line (two-dot chain line) is included to clarify the change of the position of the movable stand 110*a* of the apparatus main body 100.

As the process cartridge 70*a* in FIG. 7 shows, a first boss 80 and a second boss 81, which are engagement portions, are disposed on the cleaning frame body 14, at positions on the downstream side in the inserting direction F. The second boss 81 is disposed on the upstream side of the first boss 80 in the inserting direction F. The first boss 80 and the second boss 81 are located on the same side as the developing unit 4 with respect to the optical path of the laser light 3*a*. The first boss 80 and the second boss 81 are located on the opposite side of a developing unit 4 of the adjacent process cartridge 70 (another developing cartridge) with respect to the optical path of the laser light 3*a*.

The first boss 80 and the second boss 81 are disposed on the side face of the cleaning frame body 14 facing the developing unit 4, so as to protrude toward the developing unit 4.

The first boss 80 and the second boss 81 are disposed between the cleaning unit 26 and the developing unit 4 as shown in FIG. 3 and FIG. 7. The first boss 80 and the second boss 81 are disposed on the cleaning frame body 14 of the downstream side in the inserting direction F (first frame portion) with respect to the opening 14*c*, where the laser light 3*a* can transmit through (portion indicated by the broken line in FIG. 3). Further, in a direction orthogonal to the inserting direction F, the first boss 80 and the second boss 81 are disposed on the cleaning frame body 14 in a portion where the opening 14C does not exist.

By disposing the first boss 80 and the second boss 81 on the cleaning frame body 14 like this in a region where rigidity is high, engagement with the later mentioned movable stand 110*a* of the apparatus main body 100*a* can be ensured.

Here the opening 14*c* of the cleaning frame body 14, the first boss 80 and the second boss 81 will be described with reference to FIG. 1 and FIG. 3.

In the cleaning unit 26, the opening 14*c* is created in the cleaning frame body 14, between the center of the photosensitive body 1 and the first guided portion 14*d* of the cleaning frame body 14. The opening 14*c* is created in a direction where the cleaning unit 26 and the developing unit 4 face each other (arrow K direction in FIG. 3). When an image is formed, the laser light 3*a*, emitted from the scanner unit 3, transmits through the opening 14*c*, and is irradiated onto the photosensitive body 1.

The cleaning frame body 14 has a first frame portion which is more distant from the photosensitive body 1 and a second frame portion which is closer to the photosensitive body 1, so as to sandwich the opening 14*c* and the optical path of the laser light 3*a*. The first boss 80 and the second boss 81 are disposed on the first frame portion. The first frame portion is located on the same side as the developing unit 4 with respect to the optical path of the laser light 3*a*, as shown in FIG. 3. The first frame portion is located on the opposite side of the developing unit 4 (another developing cartridge) of an adjacent process cartridge 70 with respect to the optical path of the laser light 3*a*.

By creating the opening 14*c* like this so that the first and second frame portions of the cleaning frame body 14 sandwich the optical path of the laser light 3*a*, the frame size, in the direction where the process cartridges 70 adjoins each other, can be decreased. In other words, the width of the process cartridge 70 in the direction of the cleaning unit 26 and the developing unit 4 facing each other (arrow K direction in FIG. 3) can be decreased in the opening 14*c* and in the region distant from the center of the photosensitive body 1 of the opening 14*c*. As a result, the process cartridge 70 can be downsized, and the interval between the adjacent process cartridges 70 can be decreased.

Figure 8A:
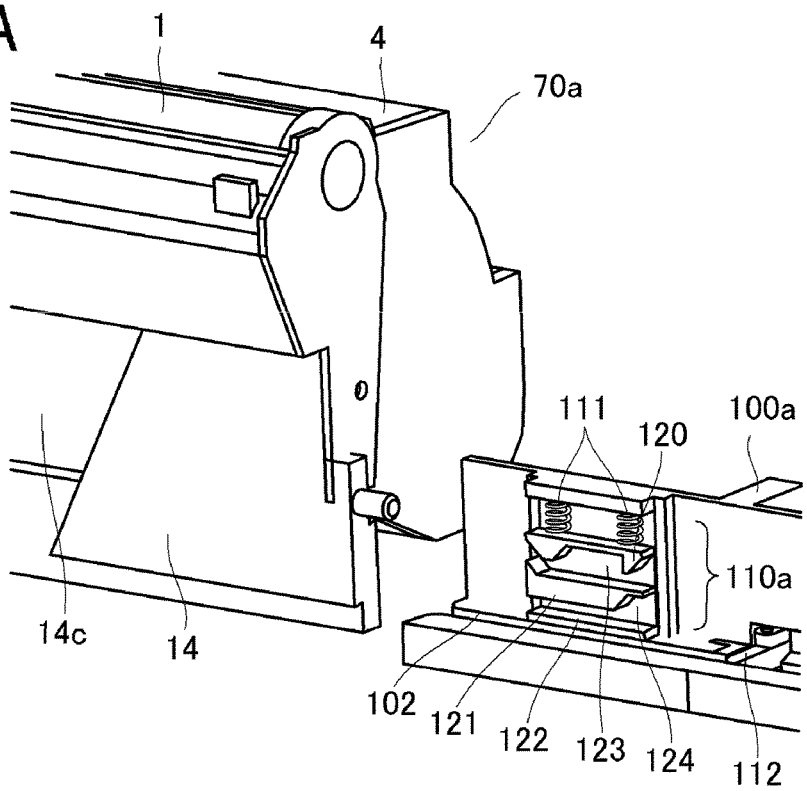
FIGS. 8A and 8B are schematic diagrams depicting a key portion of the process cartridge and a movable stand of the apparatus main body.
Figure 8B:
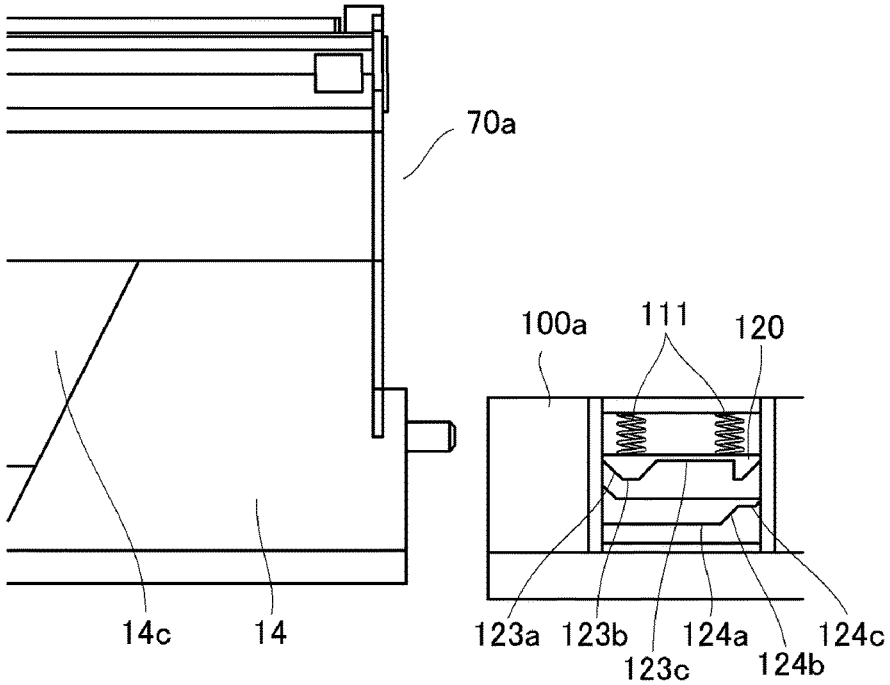

FIGS. 8A and 8B show schematic diagrams depicting a key portion of the process cartridge 70*a* and the movable stand 110*a* of the apparatus main body 100*a*, viewing the process cartridge 70 in the arrow Q direction in FIG. 3.

As shown in FIGS. 8A and 8B, the apparatus main body 100*a* includes the lower installation guide portion 102 to guide insertion of the process cartridge 70*a*, the movable stand 100*a* which is disposed to be movable, and the urging spring 111 to energize the movable stand 110*a* to a predetermined position.

The movable stand 110*a* corresponds to a movable member, where the first boss 80, the second boss 81 and the engaged portion which is engaged when the cartridge is inserted, are disposed on the process cartridge 70*a*.

The movable stand 110*a* is constituted by an upper guide portion 120, an intermediate guide portion 121 and a lower guide portion 122. The upper guide portion 120 and the intermediate guide portion 121 constitute a first insertion guide portion 123 used as an engaged portion, and the intermediate guide portion 121 and the lower guide portion 122 constitute a second insertion guide portion 124 used as an engaged portion.

The first insertion guide portion 123 has a labyrinth shape formed in the upper guide portion 120 constituted by a slope 123*a*, a first planar portion 123*b*, a concave portion 123*c* and the like, and has a size that allows engaging with the first boss 80. The second insertion guide portion 124 has a labyrinth shape formed in the intermediate guide portion 121, constituted by a first planar portion 124*a*, a slope 124*b*, a second planar portion 124*c* and the like, and has a size that allows engaging with the second boss 81.

Further, as shown in FIGS. 8A and 8B, a stopper member 112, which interlocks with the movable stand 110*a*, is disposed on the apparatus main body 100*a*. The movable stand 110*a* and the stopper member 112 are connected.

In this example, the movable stand 110*a* is disposed between the cleaning unit 26 and the developing unit 4 in the state where the process cartridge 70*a* is installed in the apparatus main body 100*a*.

If a boss for preventing an insertion error is disposed on the outer side face extending in the installing direction of the process cartridge, in the conventional configuration where a plurality of process cartridges are installed in the apparatus main body, a space to dispose the movable stand is required between adjacent process cartridges. In this example, on the other hand, the movable stand 110*a* is located between the cleaning unit 26 and the developing unit 4, thereby the interval between adjacent process cartridges 70*a* can be smaller. As a result, the installation space of the plurality of process cartridges 70 in the apparatus main body 100 can be saved, and the image forming apparatus can be downsized.

Now the relationship of the first boss 80 and the second boss 81 of the process cartridge 70*a* and the movable stand 110*a* disposed on the apparatus main body 100*a* when a compatible process cartridge 70*a* is inserted into the apparatus main body 100*a* will be described with reference to FIG. 9A to FIG. 9F. In FIGS. 9A to 9F, the right side is the front side of the apparatus main body 100*a*, and the left side is the rear side of the apparatus main body 100*a*.

Figure 9A:
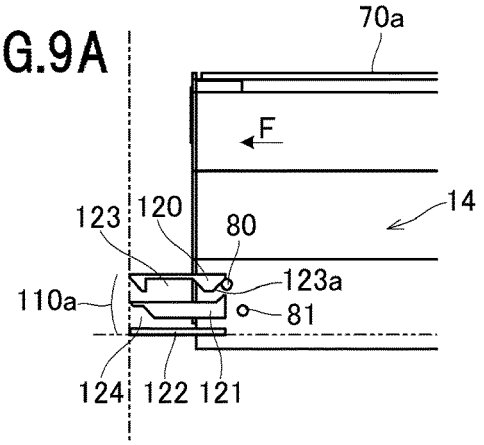
FIGS. 9A to 9F are diagrams depicting the operation when a compatible process cartridge is inserted into the apparatus main body.

First, when the process cartridge 70*a* moves in the inserting direction F, as shown in FIG. 9A, the first boss 80 of the process cartridge 70*a* is engaged with the first insertion guide portion 123 disposed on the movable stand 110*a*.

Figure 9D:
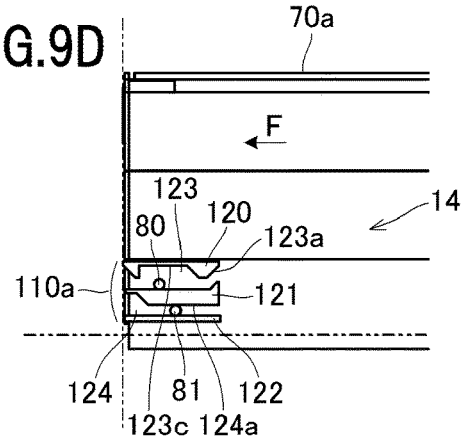
Figure 9B:
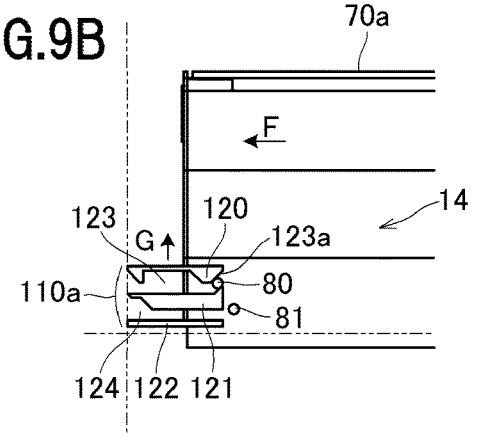

Then when the process cartridge 70*a* moves further in the inserting direction F, the first boss 80 contacts the slope 123*a* created at the entrance of the first insertion guide portion 123, as shown in FIG. 9B. Thereby the movable stand 110*a*, which has been energized downward by the urging spring 111, receives force from the process cartridge 70*a* and moves upward (arrow G direction) against the energizing force of the urging spring 111.

Figure 9E:
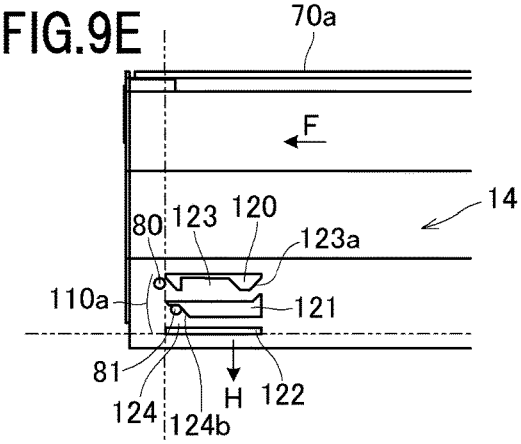
Figure 9C:
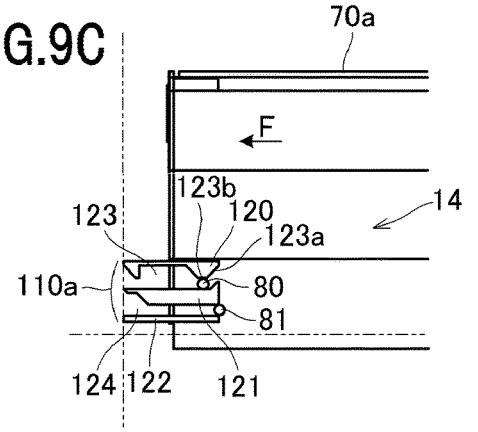

When the process cartridge 70*a* moves further in the inserting direction F, the first boss 80 reaches the first planar portion 123*b* of the first insertion guide portion 123, as shown in FIG. 9C. At this time, the second insertion guide portion 124 of the movable stand 110*a* which has moved up and the second boss 81 of the process cartridge 70*a* are in positions allowing engagement.

When the process cartridge 70*a* moves further in the inserting direction F, the second boss 81 which has engaged with the second insertion guide portion 124 contacts the first planar portion 124*a* of the second insertion guide portion 124, as shown in FIG. 9D. Thereby the process cartridge 70*a* can be moved in the inserting direction F while the movable stand 110*a* is held in the upper position.

Figure 9F:
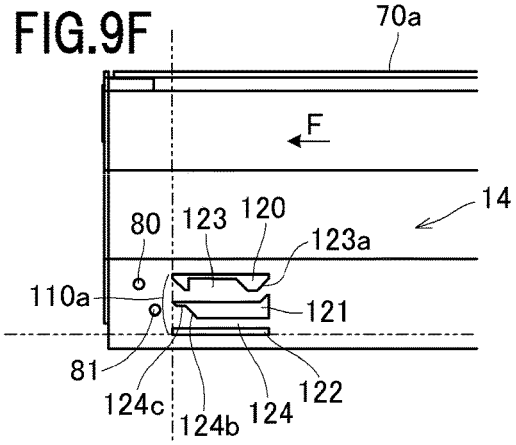

When the process cartridge 70*a* moves further in the inserting direction F, and the second boss 81 reaches the position of the slope 124*b* of the second insertion guide portion 124, as shown in FIG. 9E, the movable stand 110*a* moves downward (arrow H direction) in tandem with the insertion of the process cartridge 70*a*. FIG. 9F shows the state where the process cartridge 70*a* is inserted in the apparatus main body 100*a*.

Thereby the process cartridge 70*a*, which is compatible with the apparatus main body 100*a*, can be inserted into the apparatus main body 100*a*.

Now the relationship between the first boss 80 and the second boss 81 of the process cartridge 70*a* and the movable stand 110*a*, when the process cartridge 70*a* is ejected from the apparatus main body 100*a*, will be described with reference to FIG. 10A to FIG. 10F. When the process cartridge 70*a* is ejected from the apparatus main body 100*a*, the process cartridge 70*a* moves from the rear side of the apparatus opening 101 to the front side thereof.

Figure 10A:
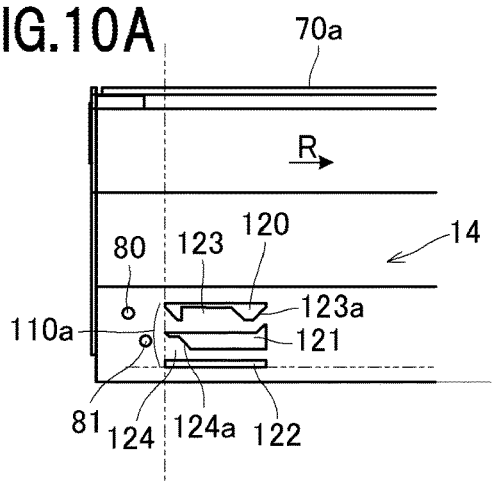
FIGS. 10A to 10F are diagrams depicting the operation when a compatible process cartridge is ejected from the apparatus main body.
Figure 10D:
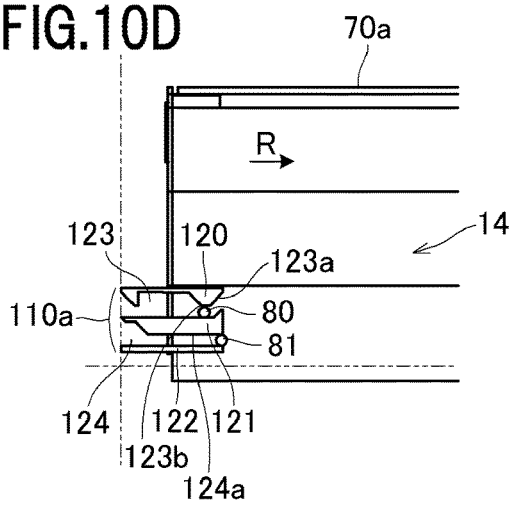
Figure 10B:
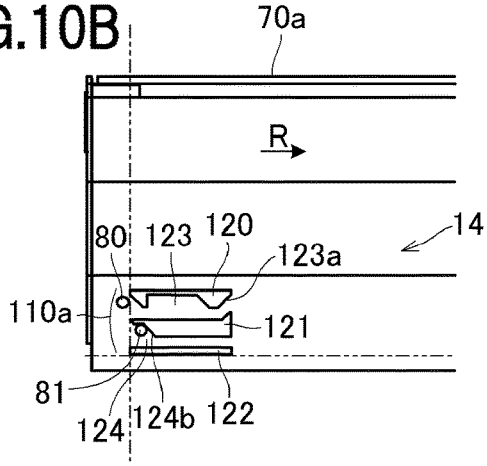

FIG. 10A shows a state when the process cartridge 70*a* is inserted in the apparatus main body 100*a*, just like FIG. 9F. When the process cartridge 70*a* moves in the ejecting direction R, the second boss 81 is engaged with the second insertion guide portion 124 and contacts the slope 124*b*, as shown in FIG. 10B.

When the process cartridge 70*a* moves further in the ejecting direction R, the movable stand 110*a* receives force from the process cartridge 70*a* because the second boss 81 is in contact with the slope 124*b*. As a result, the movable stand 110*a*, which has been energized downward by the urging spring 111, moves upward (arrow G direction) against the energizing force of the urging spring 111, and the first boss 80 is also engaged with the insertion guide portion 123 of the movable stand 110*a*.

When the movable stand 110*a* moves upward, the second boss 81 contacts the first planar portion 124*a* of the second insertion guide portion 124. When the process cartridge 70*a* moves further in the ejecting direction R in this state, the process cartridge 70*a* is ejected in the state where the movable stand 110*a* is held in the upper position, as shown in FIG. 10C and FIG. 10D.

Figure 10E:
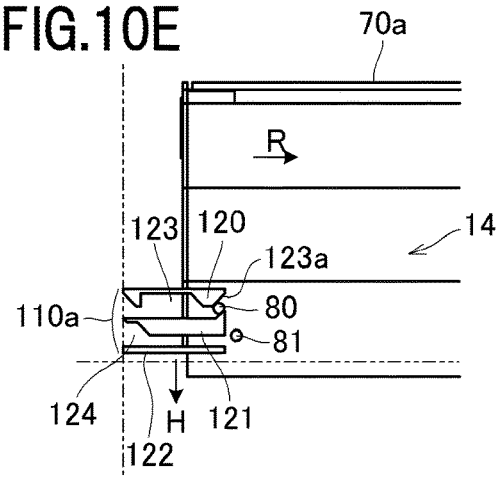
Figure 10C:
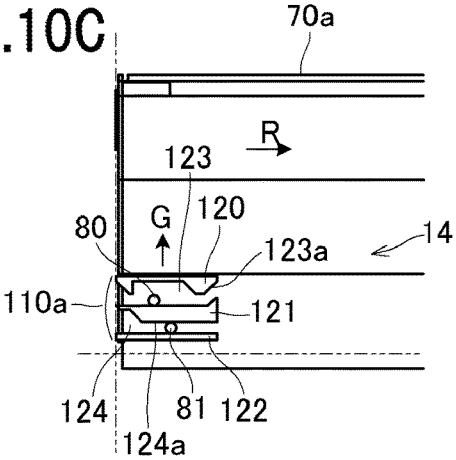

FIG. 10E shows a state when the process cartridge 70*a* moves further in the ejecting direction R. As shown in FIG. 10E, when the first boss 80 moves to the position of the slope 123*a* of the first insertion guide portion 123 of the movable stand 110*a*, the movable stand 110*a* moves downward (arrow H direction) in tandem with ejection of the process cartridge 70*a*.

Figure 10F:
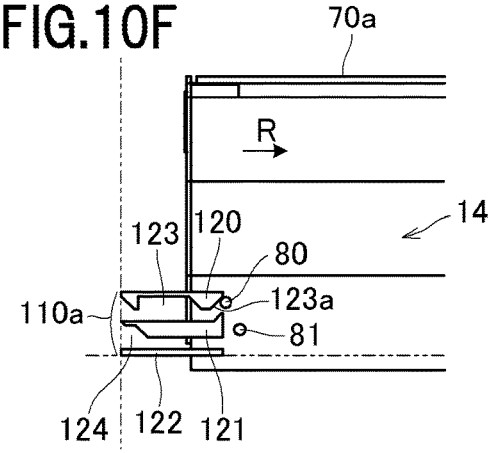

FIG. 10F shows a state when the respective engaged state between the first boss 80 and the second boss 81 of the process cartridge 70*a* and the first insertion guide portion 123 and the second insertion guide portion 124 of the movable stand 110*a* is cleared.

Thus the process cartridge 70*a*, which is compatible with the apparatus main body 100*a*, can be ejected from the apparatus main body 100*a*.

Now the relationship between the first boss and the second boss of a process cartridge 70A and the movable stand 110 when the process cartridge 70A, which is incompatible with the apparatus main body 10*a*, is inserted into the apparatus main body 100*a*, will be described.

Figure 11A:
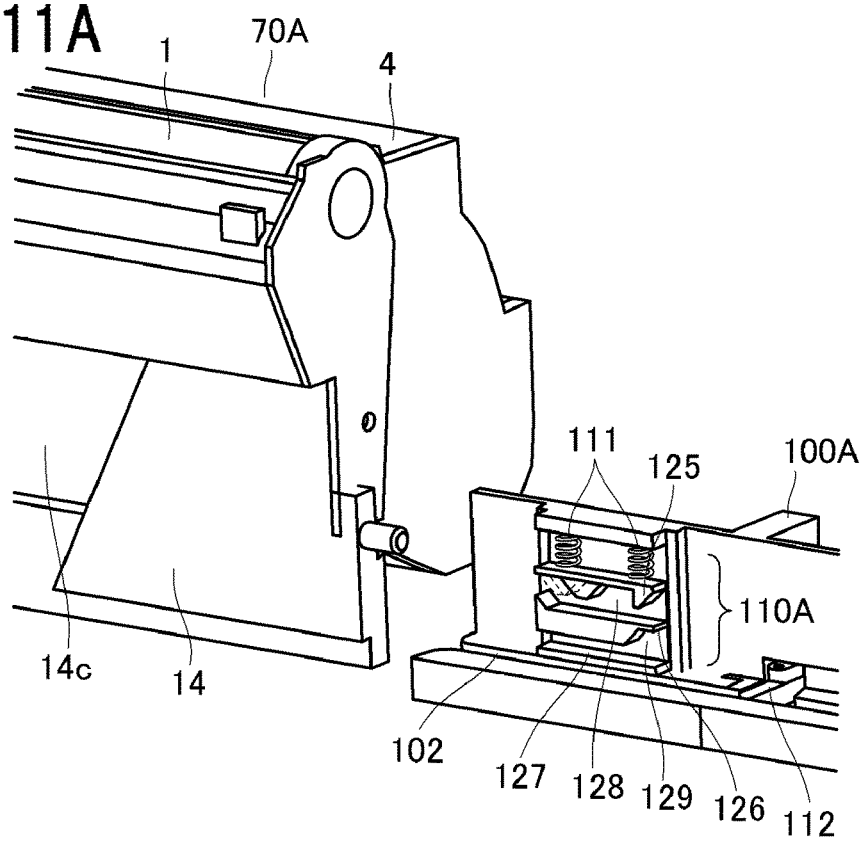
FIGS. 11A and 11B are diagrams depicting the key portion of the process cartridge and the movable stand of the apparatus main body.
Figure 11B:
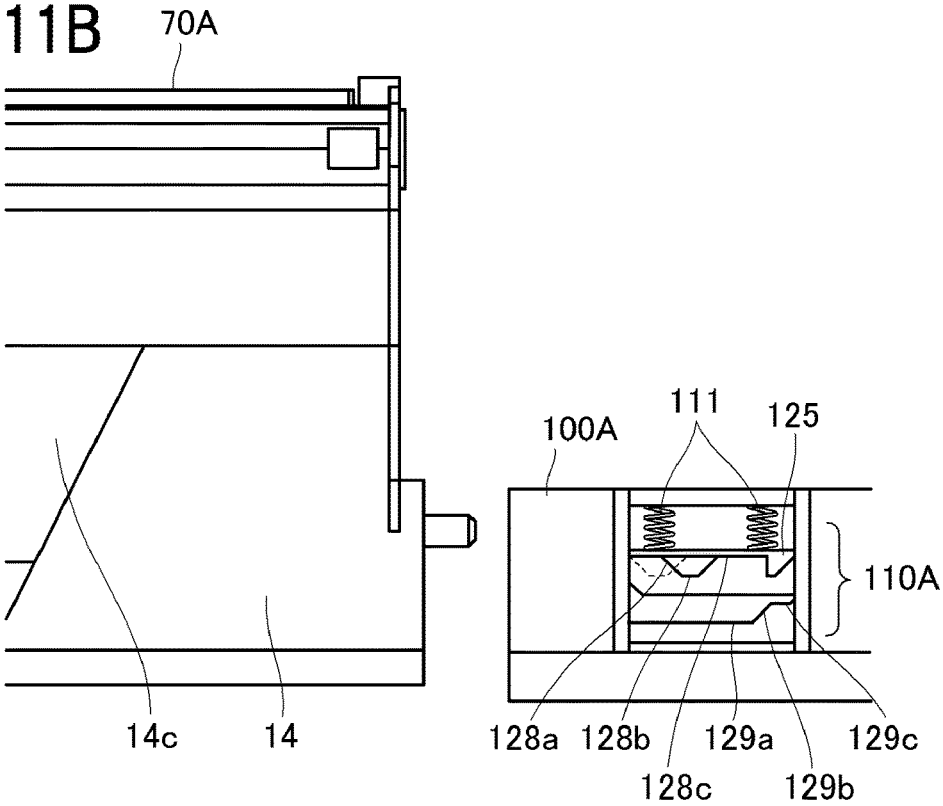

First an apparatus main body 100A, which is different from the apparatus main body 100*a*, and the process cartridge 70A which is compatible with the apparatus main body 100A, will be described. FIGS. 11A and 11B shows schematic diagrams depicting a key portion of the process cartridge 70A and the movable stand 110A of the apparatus main body 100A, viewing the process cartridge 70 in the arrow Q direction in FIG. 3.

As shown in FIGS. 11A and 11B, the apparatus main body 100A includes a movable stand 100A constituted by: an upper guide portion 125, an intermediate guide portion 126 and a lower guide portion 127. The upper guide portion 125 and the intermediate guide portion 126 constitute a first insertion guide portion 128 used as an engaged portion, and the intermediate guide portion 126 and the lower guide portion 127 constitute a second insertion guide portion 129 used as an engaged portion. The positions of a slope 128*a* of the first insertion guide portion 128 and a first planar portion 128*b* disposed on the movable stand 110A are shifted from the positions in the movable stand 110*a*. The positions of the slope 123*a* and the first planar portion 123*b* in the first insertion guide portion 123 of the movable stand 110*a* are indicated by a broken line in FIGS. 11A and 11B.

Figure 12:
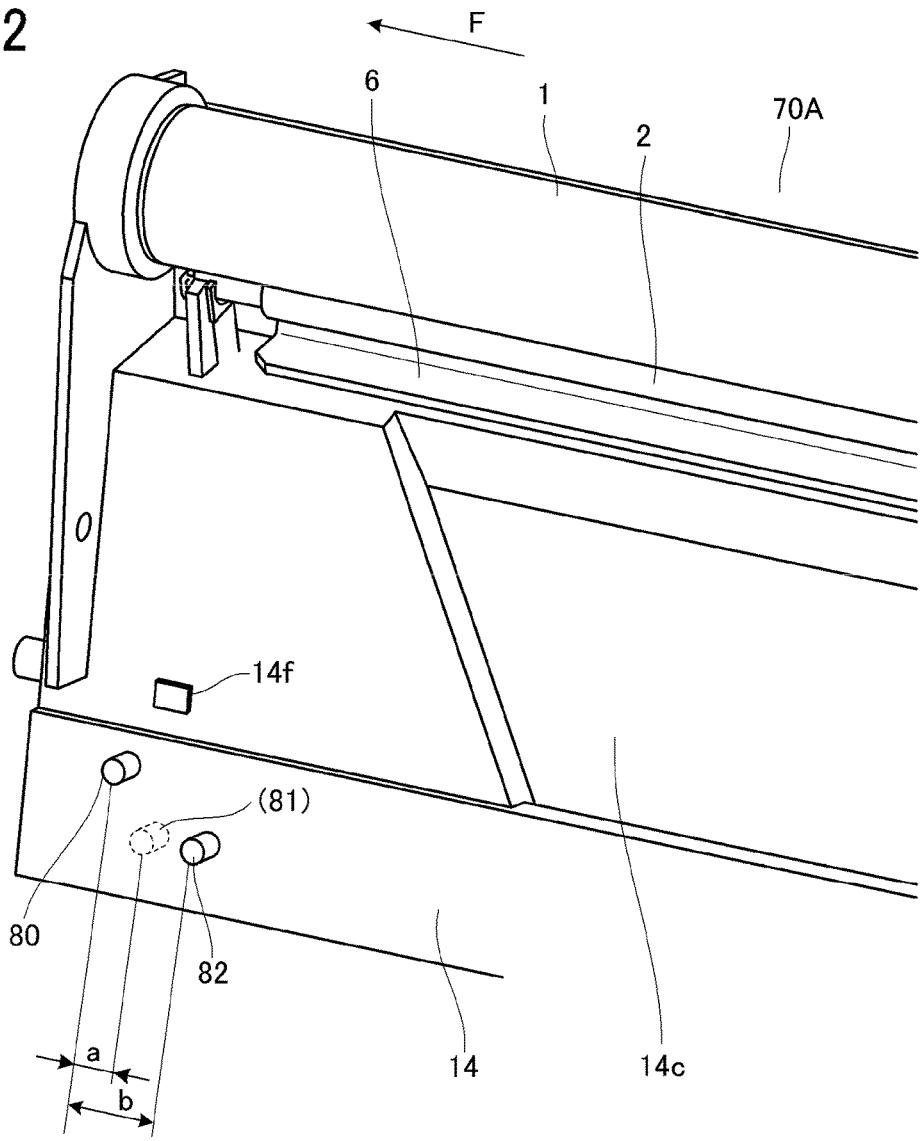
FIG. 12 is a diagram depicting the key portion of the process cartridge.

FIG. 12 is a schematic diagram depicting a key portion of the process cartridge 70A, viewing the process cartridge 70 in the arrow P direction in FIG. 3. In FIG. 12, the developing unit 4 is omitted to make explanation easier.

As the process cartridge 70A in FIG. 12 shows, the position of the second boss 82 is shifted from the second boss 81 of the process cartridge 70*a*. The position of the second boss 81 of the process cartridge 70*a* is indicated by the broken line in FIG. 12. The first boss 80 of the process cartridge 70*a* is the same as the first boss 80 of the process cartridge 70A.

In this example, as shown in FIG. 12, the position of the second boss 82 is set so that the interval b, between the first boss 80 and the second boss 82 in the inserting direction F, is longer than the interval a between the first boss 80 and the second boss 81.

Now the relationship between the first boss 80 and the second boss 82 of the process cartridge 70A and the movable stand 110*a* when the process cartridge 70A, which is incompatible with the main body 100*a*, is inserted into the apparatus main body 100*a*, will be described with reference to FIG. 13A to FIG. 13C. When the process cartridge 70A is inserted into the apparatus main body 100*a*, the process cartridge 70A moves from the front side of the apparatus opening 101 to the rear side thereof.

Figure 13A:
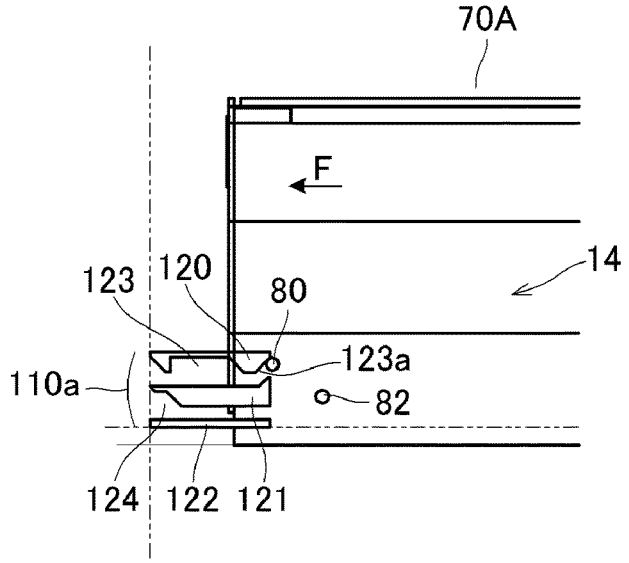
FIGS. 13A to 13C are diagrams depicting the operation when an incompatible process cartridge is inserted into the apparatus main body.

First, when the process cartridge 70A moves in the inserting direction F, as shown in FIG. 13A, the first boss 80 of the process cartridge 70A is engaged with the first insertion guide portion 123 of the movable stand 110*a*.

Figure 13B:
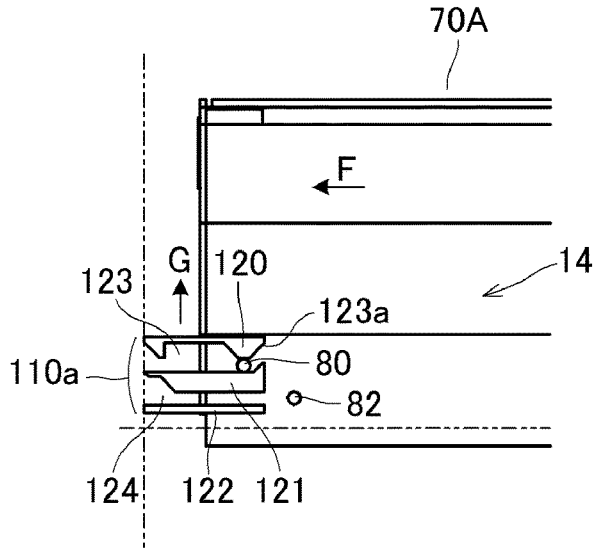

Then, when the process cartridge 70A moves further in the inserting direction F, the first boss 80 contacts the slope 123*a* created at the entrance of the first insertion guide portion 123, as shown in FIG. 13B. Thereby the movable stand 110*a*, which has been energized downward by the urging spring 111, receives force from the process cartridge 70A and moves upward (arrow G direction) against the energizing force of the urging spring 111.

Figure 13C:
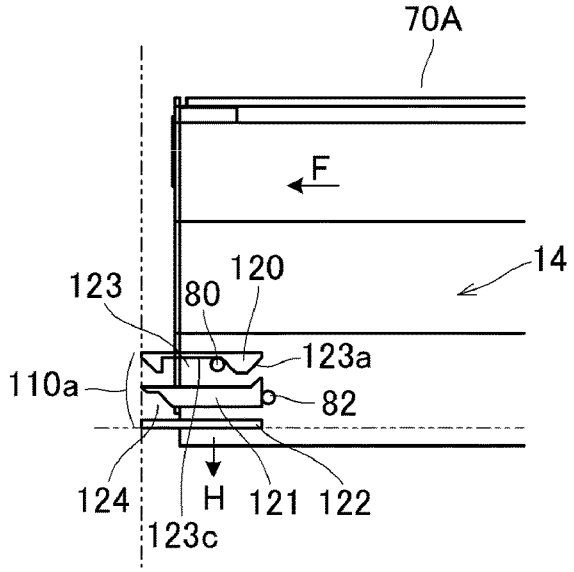

When the process cartridge 70A moves further in the inserting direction F, the first boss 80 moves to the concave portion 123*c* of the first insertion guide portion 123, as shown in FIG. 13C, hence the movable stand 110*a* moves downward (arrow H direction).

Thereby movement of the second boss 82 of the process cartridge 70A to the insertion guide portion 124 of the movable stand 110*a* is prevented, and the second boss 82 cannot engage with the insertion guide portion 124.

Now the relationship between the first boss 80 and the second boss 81 of the process cartridge 70*a* and the movable stand 110A, when the process cartridge 70*a*, which is incompatible with the apparatus main body 100A, is inserted into the apparatus main body 100A, will be described with reference to FIG. 14A and FIG. 14B. When the process cartridge 70*a* is inserted into the apparatus main body 100A, the process cartridge 70*a* moves from the front side of the apparatus opening of the apparatus main body 100A toward the rear side thereof.

Figure 14A:
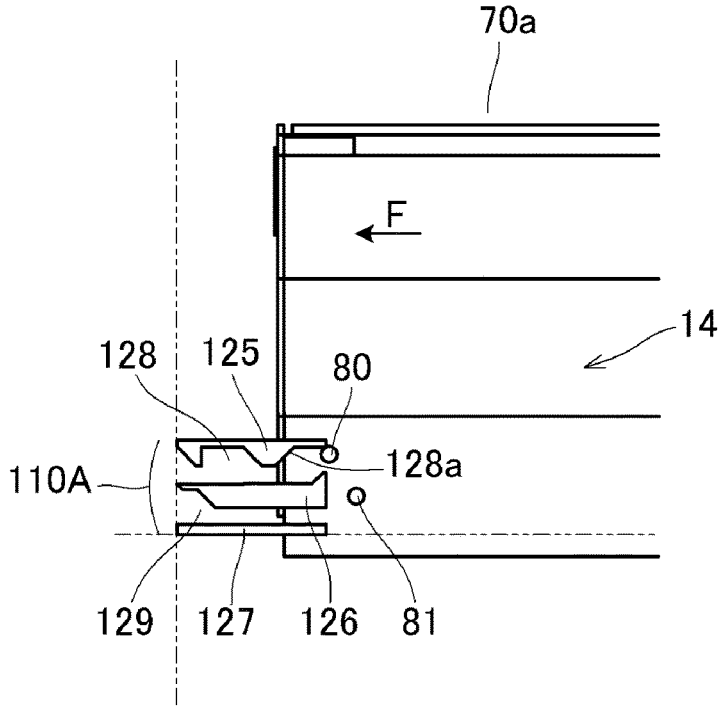
FIGS. 14A and 14B are diagrams depicting the operation when an incompatible process cartridge is inserted into the apparatus main body.

First, when the process cartridge 70*a* moves in the inserting direction F, as shown in FIG. 14A, the first boss 80 of the process cartridge 70*a* is engaged with the first insertion guide portion 128 disposed on the movable stand 110A.

Figure 14B:
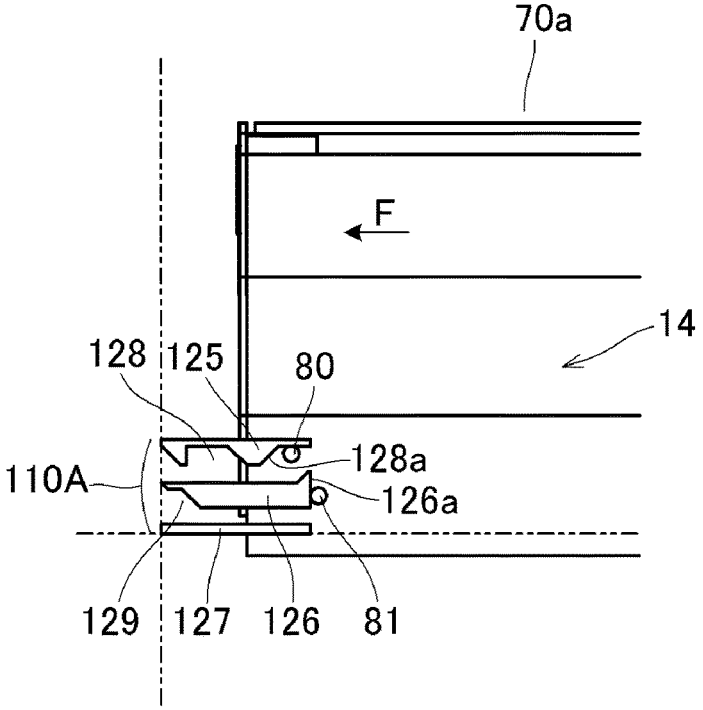

Then, when the process cartridge 70*a* moves further in the inserting direction F, as shown in FIG. 14B the second boss 81 of the process cartridge 70*a* contacts the planar portion 126*a* of the intermediate guide portion 126 of the movable stand 110A. Thereby the second boss 81 of the process cartridge 70*a* cannot engage with the insertion guide portion 129 of the movable stand 110A.

As mentioned above, according to this example, the process cartridge 70A (70*a*), which is incompatible with the apparatus main body 100*a* (100A), cannot be inserted into the apparatus main body 100*a* (100A). This allows to prevent the insertion of the incompatible process cartridge 70A (70*a*) into the apparatus main body 100*a* (100A) by mistake. In this example, the first boss 80, the second boss 81 and the movable stand 110*a* are located between the cleaning unit 26 and the developing unit 4, hence the interval between adjacent process cartridges 70*a* can be set small. As a result, the installation space of a plurality of process cartridges 70 in the apparatus main body 100 can be saved, and the image forming apparatus can be downsized.

Therefore insertion of the process cartridge 70 into the apparatus main body 100 can be prevented if the process cartridge 70 is incompatible with the apparatus main body 100, and the image forming apparatus can still be downsized.

In this example, the bosses (80, 81) are used as the engagement portions, and the labyrinth-shaped insertion guide portions (123, 124) are used as the engaged portions, but the present invention is not limited to this. A plurality of engagement portions may be disposed, and engaged portions having shape patterns corresponding to the plurality of engagement portions may be disposed so as to prevent insertion of many types of process cartridges. In other words, any engagement portion and engaged portion may be used only if the engagement portion which engages with the engaged portion disposed on the apparatus main body 100, when the process cartridge is attached to/detached from the apparatus main body 100, is disposed on the cleaning frame body 14, so as to protrude toward the side where the developing unit 4 is disposed.

Further, in this example, the movable stand 110*a* which engages with each boss to allow movement of the process cartridge 70*a* in the inserting direction F, and the movable stand 110A which engages with each boss so as not to allow movement, were described, but the movable members are not limited to these stands. In other words, any movable member may be used only if movement of the cleaning unit 26 to the installation position in the apparatus main body 100 is or is not allowed depending on the type of the movable member where the engaged portion is disposed.

Figure 15A:
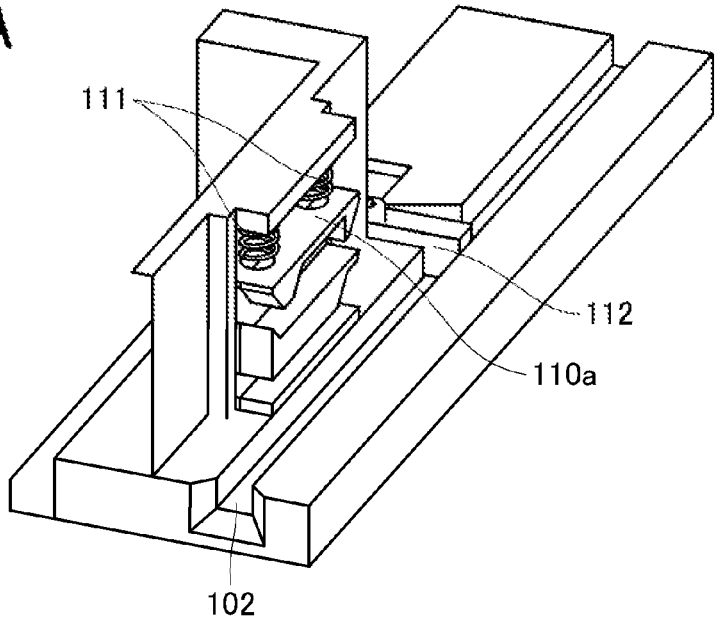
FIGS. 15A and 15B are diagrams depicting a stopper member disposed on the apparatus main body.
Figure 15B:
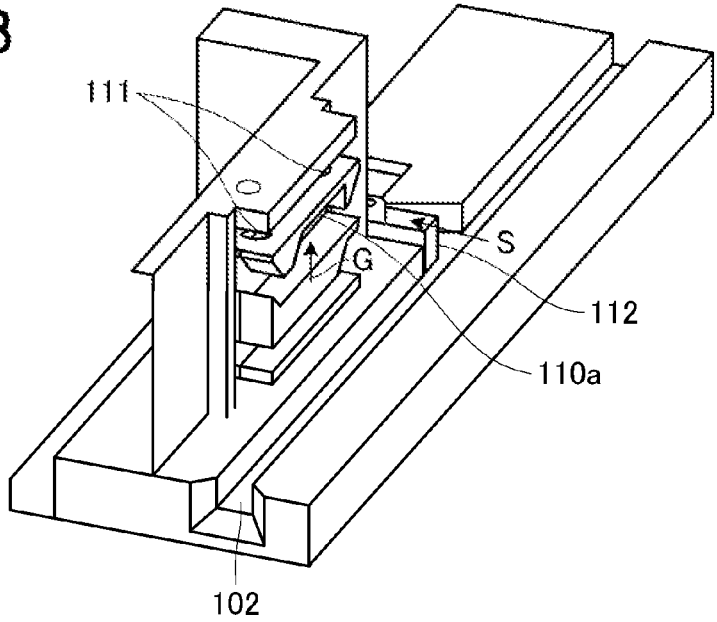

Now the function of a stopper member 112 disposed on the apparatus main body 100*a* will be described with reference to FIGS. 15A and 15B. FIGS. 15A and 15B show schematic diagrams depicting the stopper member 112. As shown in FIG. 15A, when the process cartridge 70*a* is not inserted into the apparatus main body 100*a*, the stopper member 112 protrude toward a position contacting the process cartridge 70*a* in the lower installation guide portion 102.

If the process cartridge 70*a* is inserted as shown in FIG. 15B, the movable stand 110*a* engages with the first boss 80 and the second boss 81 and moves upward (arrow G direction). As a result, the stopper member 112 connected with the movable stand 110*a* by a connecting mechanism, such as a cam link, moves in the arrow S direction, and retracts from the lower installation guide portion 102, whereby the process cartridge 70*a* can be inserted into the apparatus main body 100*a*.

By disposing this stopper member 112 that interlocks with the movable stand 110*a*, the insertion of the process cartridge can be prevented if the movable stand 110*a* malfunctions.

For example, a case when the first boss 80 and/or the second boss 81 (82) disposed on the process cartridge 70*a* (70A) is/are damaged, and the movable stand 110*a* cannot be moved is considered. If such a process cartridge 70*a* (70A) is inserted into the apparatus main body 100*a*, it cannot be recognized whether the process cartridge 70*a* is compatible or not with the apparatus main body 100*a*. However, even if the process cartridge 70*a* (70A) is inserted, the movable stand 110*a* cannot move, and the stopper member 112 interlocking with the movable stand 110*a* cannot be either.

Therefore the process cartridge 70*a* (70A) contacts the stopper member 112, and insertion of the process cartridge 70*a* (70A) is prevented. As a result, insertion of an incompatible process cartridge 70A by mistake can be prevented in advance.

Figure 16A:
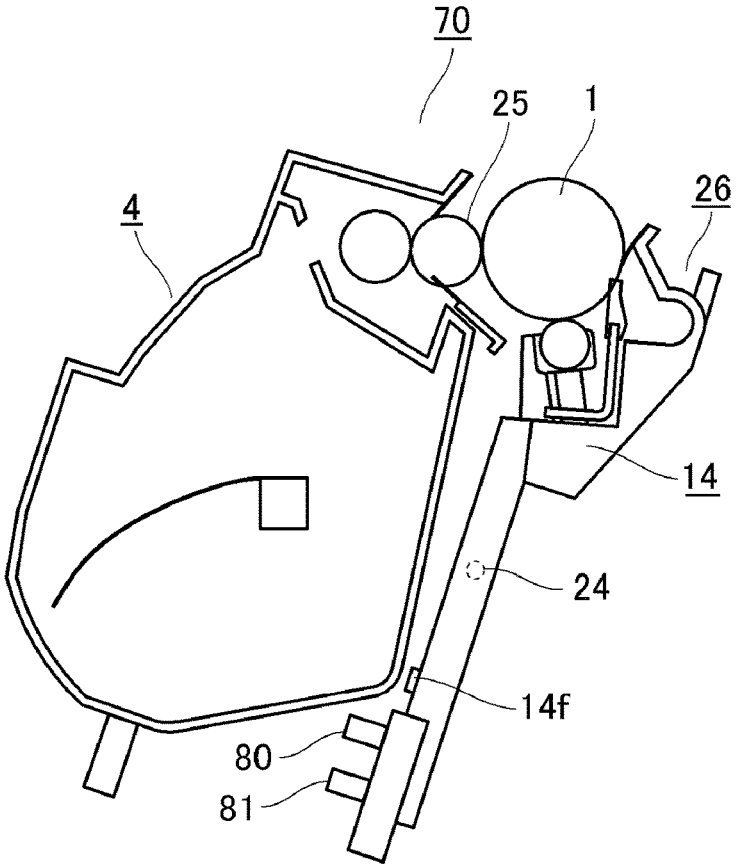
FIGS. 16A and 16B are schematic cross-sectional views depicting states where the photosensitive body and the developing roller are contacted and separated.
Figure 16B:
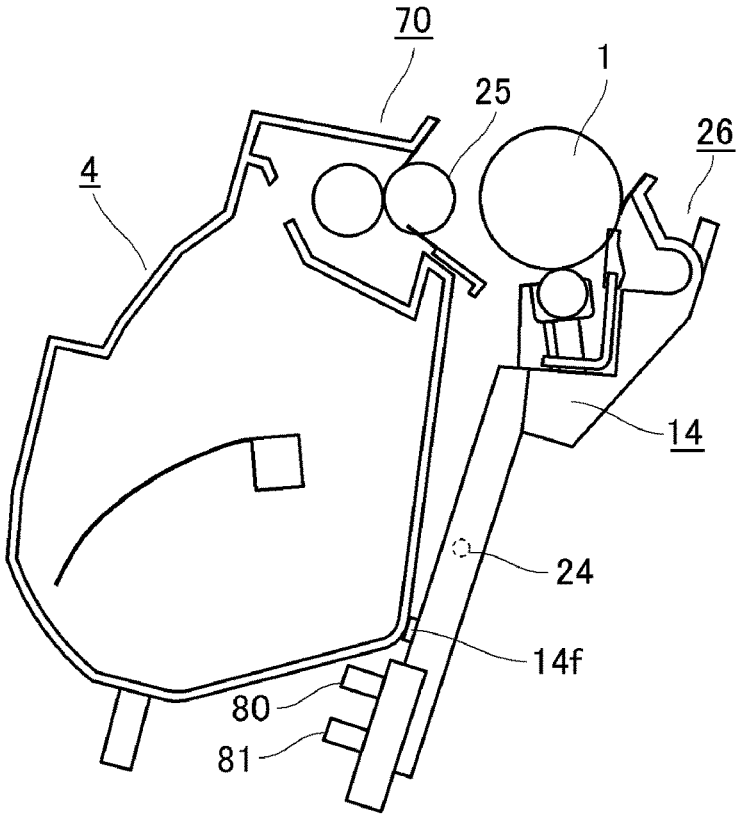

Now a configuration for preventing damage to the first boss 80 and the second boss 81 during physical distribution of the process cartridge 70 will be described with reference to FIGS. 16A and 16B. FIGS. 16A and 16B show schematic cross-sectional views depicting states when the photosensitive body 1 and the developing roller 25 are contacted to or separated from each other in the process cartridge 70.

As mentioned above, the developing unit 4 is connected to the cleaning unit 26, so as to be rotatable around the fitting shaft 24 supported by the cleaning frame body 14 of the cleaning unit 26.

FIG. 16A shows a state when the developing unit 4 is rotating around the fitting shaft 24, and the photosensitive body 1 and the developing roller 25 are contacted to each other. In this case, the control portion 14*f* of the cleaning frame body 14 is separated from the developing unit 4.

FIG. 16B shows a state when the developing unit 4 is rotating around the fitting shaft 24, and the photosensitive body 1 and the developing roller 25 are contacted to each other. The state in FIG. 16B is a state when the process cartridge 70 is separated due to vibration or impact during physical distribution.

In such a case, the control portion 14*f* of the cleaning frame body 14 contacts with the developing unit 4, whereby damage to the first boss 80 caused by contacting the developing unit 4 can be prevented.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-038036, filed Feb. 27, 2015, which is hereby incorporated by reference herein in its entirety.

What is claimed is:

1. A cleaning apparatus comprising a photosensitive body and a frame body that supports the photosensitive body and being attachable to and detachable from an installation position in an apparatus main body of an image forming apparatus configured to form an image on a recording material, the cleaning apparatus being installed in the apparatus main body with a developing apparatus including a developer bearing member that bears developer for developing an electrostatic image formed on the photosensitive body, wherein a surface of the frame body faces toward a side where the developing apparatus is provided in an arrangement direction of the developing apparatus and the cleaning apparatus being installed in the apparatus main body, and a projection portion projects from the surface of the frame body, and moves an engaged portion, which is disposed on the apparatus main body, so as to allow a movement of the cleaning apparatus to the installation position when the cleaning apparatus is attached to the apparatus main body.

2. The cleaning apparatus according to claim 1, wherein the cleaning apparatus, integrated with the developing apparatus, is attachable to and detachable from the apparatus main body.

3. The cleaning apparatus according to claim 1, wherein the projecting portion is located on the same side as the developing apparatus with respect to an optical path of a laser light for exposing the photosensitive body.

4. The cleaning apparatus according to claim 3, which is installed in the apparatus main body in a position that is on the opposite side to the side adjoining the developing apparatus and which adjoins another developing apparatus, wherein the projecting portion is located so as to sandwich the optical path with the other developing apparatus.

5. The cleaning apparatus according to claim 1, wherein the frame body comprises:

an opening through which laser light for exposing the photosensitive body transmits; and a first frame portion located more distant from the photosensitive body and a second frame portion located closer to the photosensitive body, which sandwich the opening and the optical path of the laser light, and the first frame portion is located on the same side as the developing apparatus with respect to the optical path, and the projecting portion is provided on the first frame portion.

6. The cleaning apparatus according to claim 5, which is installed in the apparatus main body in a position that is on the opposite side to the side adjoining the developing apparatus and which adjoins another developing cartridge, wherein the first frame portion is located so as to sandwich the optical path with the other developing apparatus.

7. The cleaning apparatus according to claim 1, wherein the projecting portion is a boss.

8. The cleaning apparatus according to claim 1, further comprising:

a charging member configured to charge the photosensitive body;

a cleaning member configured to clean the surface of the photosensitive body; and a housing portion configured to store removed matter which the cleaning member has removed from the photosensitive body.

9. A process cartridge attachable to and detachable from an apparatus main body of an image forming apparatus, comprising:

the cleaning apparatus according to claim 1; and a developing apparatus including a developer bearing member that bears developer for developing an electrostatic image formed on the photosensitive body.

10. An image forming apparatus forming an image on a recording material, wherein the cleaning apparatus according to claim 1 is configured in plurality to be attachable to and detachable from the apparatus main body.

11. A cleaning apparatus comprising a photosensitive body and a frame body that supports the photosensitive body and being attachable to and detachable from an installation position in an apparatus main body of an image forming apparatus configured to form an image on a recording material, the cleaning apparatus being installed in the apparatus main body with a developing apparatus including a developer bearing member that bears developer for developing an electrostatic image formed on the photosensitive body, wherein, when the developing apparatus and the cleaning apparatus are installed in the apparatus main body, a surface of the frame body faces the developing apparatus, and a projecting portion projects from the surface of the frame body, and moves an engaged portion, which is disposed on the apparatus main body, so as to allow a movement of the cleaning apparatus to the installation position when the cleaning apparatus is attached to the apparatus main body.

12. The cleaning apparatus according to claim 11, wherein the cleaning apparatus, integrated with the developing apparatus, is attachable to and detachable from the apparatus main body.

13. The cleaning apparatus according to claim 11, wherein the projecting portion is located on the same side as the developing apparatus with respect to an optical path of a laser light for exposing the photosensitive body.

14. The cleaning apparatus according to claim 13, which is installed in the apparatus main body in a position that is on the opposite side to the side adjoining the developing apparatus and which adjoins another developing apparatus, wherein the projecting portion is located so as to sandwich the optical path with the other developing apparatus.

15. The cleaning apparatus according to claim 11, wherein the frame body comprises:

an opening through which laser light for exposing the photosensitive body transmits; and a first frame portion located more distant from the photosensitive body and a second frame portion located closer to the photosensitive body, which sandwich the opening and the optical path of the laser light, and the first frame portion is located on the same side as the developing apparatus with respect to the optical path, and the projecting portion is provided on the first frame portion.

16. The cleaning apparatus according to claim 15, which is installed in the apparatus main body in a position that is on the opposite side to the side adjoining the developing apparatus and which adjoins another developing cartridge, wherein the first frame portion is located so as to sandwich the optical path with the other developing apparatus.

17. The cleaning apparatus according to claim 11, wherein the projecting portion is a boss.

18. The cleaning apparatus according to claim 11, further comprising:

a charging member configured to charge the photosensitive body;

a cleaning member configured to clean the surface of the photosensitive body; and a housing portion configured to store removed matter which the cleaning member has removed from the photosensitive body.

19. A process cartridge attachable to and detachable from an apparatus main body of an image forming apparatus, comprising:

the cleaning apparatus according to claim 11; and a developing apparatus including a developer bearing member that bears developer for developing an electrostatic image formed on the photosensitive body.

20. An image forming apparatus forming an image on a recording material, wherein the cleaning apparatus according to claim 11 is configured in plurality to be attachable to and detachable from the apparatus main body.

* * * * *